US006193859B1

(12) United States Patent
Contolini et al.

(10) Patent No.: US 6,193,859 B1
(45) Date of Patent: Feb. 27, 2001

(54) ELECTRIC POTENTIAL SHAPING APPARATUS FOR HOLDING A SEMICONDUCTOR WAFER DURING ELECTROPLATING

(75) Inventors: Robert J. Contolini, Lake Oswego; Jonathan Reid, Sherwood; Evan Patton, Portland; Jingbin Feng, Tigard; Steve Taatjes, West Linn, all of OR (US); John Owen Dukovic, Pleasantville, NY (US)

(73) Assignees: Novellus Systems, Inc., San Jose, CA (US); International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/074,624

(22) Filed: May 7, 1998

Related U.S. Application Data

(62) Division of application No. 08/970,120, filed on Nov. 13, 1997, now Pat. No. 6,159,354.

(51) Int. Cl.[7] ..... C25D 17/00; C25B 9/00
(52) U.S. Cl. ..... 204/224 R; 204/279
(58) Field of Search ..... 204/224 R, 212, 204/237, 279; 205/157, 96

(56) References Cited

U.S. PATENT DOCUMENTS

| | | | | |
|---|---|---|---|---|
| 3,962,047 | * | 6/1976 | Wagner | 204/15 |
| 4,137,867 | * | 2/1979 | Aigo | 118/627 |
| 4,170,959 | * | 10/1979 | Aigo | 118/627 |
| 4,246,088 | * | 1/1981 | Murphy et al. | 205/151 X |
| 4,259,166 | * | 3/1981 | Whitehurst | 204/279 |
| 4,280,882 | * | 7/1981 | Hovey | 204/15 |
| 4,304,641 | * | 12/1981 | Grandia et al. | 204/23 |
| 4,339,297 | * | 7/1982 | Aigo | 156/345 |
| 4,339,319 | * | 7/1982 | Aigo | 204/224 |
| 4,341,613 | * | 7/1982 | Prusak et al. | 204/281 |
| 4,466,864 | * | 8/1984 | Bacon et al. | 204/DIG. 7 |
| 4,469,566 | * | 9/1984 | Wray | 204/23 |
| 4,534,832 | * | 8/1985 | Doiron, Jr. | 204/15 |
| 4,565,607 | * | 1/1986 | Hanak et al. | 204/38.1 |
| 4,597,836 | * | 7/1986 | Schaer et al. | 204/4 |
| 4,696,729 | * | 9/1987 | Santini | 204/224 R |
| 4,828,654 | * | 5/1989 | Reed | 204/23 |
| 4,861,452 | * | 8/1989 | Stierman et al. | 204/297 W |
| 4,879,007 | * | 11/1989 | Wong | 204/15 |
| 4,906,346 | * | 3/1990 | Hadersbeck et al. | 204/238 |
| 4,931,149 | * | 6/1990 | Stierman et al. | 204/15 |
| 5,000,827 | * | 3/1991 | Schuster et al. | 204/15 |
| 5,024,746 | * | 6/1991 | Stierman et al. | 204/297 W |
| 5,078,852 | * | 1/1992 | Yee et al. | 204/297 R |
| 5,096,550 | * | 3/1992 | Mayer et al. | 204/129.1 |
| 5,135,636 | * | 8/1992 | Yee et al. | 205/96 |

(List continued on next page.)

OTHER PUBLICATIONS

"Upside–Down Resist Coating of Semiconductor Wafers", IBM Technical Disclosure Bulletin, vol. 32, No. 1, Jun. 1989, pp. 311–313.*

Evan E. Patton, et al., "Automated Gold Plate–Up Bath Scope Document and Machine Specifications", Tektronix Confidential, dated Aug. 4, 1989, pp. 1–13.*

*Primary Examiner*—Donald R. Valentine
(74) *Attorney, Agent, or Firm*—Skjerven Morrill MacPherson LLP; David E. Steuber

(57) ABSTRACT

An apparatus for depositing an electrically conductive layer on the surface of a wafer comprises a flange. The flange has a cylindrical wall and an annulus attached to a first end of the cylindrical wall. The annulus shields the edge region of the wafer surface during electroplating reducing the thickness of the deposited electrically conductive layer on the edge region. Further, the cylindrical wall of the flange can be provided with a plurality of apertures adjacent the wafer allowing gas bubbles entrapped on the wafer surface to readily escape.

29 Claims, 12 Drawing Sheets

U.S. PATENT DOCUMENTS 5,222,310 * 6/1993 Thompson et al. ..... 34/202
5,227,041 * 7/1993 Brogden et al. ..... 204/297 R
5,332,487 * 7/1994 Young, Jr. et al. ..... 205/80
5,372,699 * 12/1994 Rischke et al. ..... 205/129
5,377,708 * 1/1995 Bergman et al. ..... 134/105
5,391,285 * 2/1995 Lytle et al. ..... 205/123
5,405,518 * 4/1995 Hsieh et al. ..... 204/297 R
5,421,987 * 6/1995 Tzanavaras et al. ..... 205/133
5,429,733 * 7/1995 Ishida ..... 204/224 R
5,437,777 * 8/1995 Kishi ..... 204/224 R
5,441,629 * 8/1995 Kosaki ..... 205/148
5,443,707 * 8/1995 Mori ..... 204/242
5,447,615 * 9/1995 Ishida ..... 204/224 R
5,462,649 * 10/1995 Keeney et al. ..... 205/93
5,472,592 * 12/1995 Lowery ..... 205/137
5,498,325 * 3/1996 Nishimura et al. ..... 205/96
5,513,594 * 5/1996 McClanahan et al. ..... 118/503
5,522,975 * 6/1996 Andricacos et al. ..... 204/297 R
5,597,460 * 1/1997 Reynolds ..... 204/212
5,620,581 * 4/1997 Ang ..... 205/96
5,670,034 * 9/1997 Lowery ..... 205/143
5,725,745 * 3/1998 Ikegaya ..... 204/284
5,750,014 * 5/1998 Stadler et al. ..... 204/224 R
5,769,945 * 6/1998 Davis et al. ..... 118/52
5,776,327 * 7/1998 Botts et al. ..... 205/96
5,788,829 * 8/1998 Joshi et al. ..... 205/96
5,843,296 * 12/1998 Greenspan ..... 205/68
5,855,850 * 1/1999 Sittler ..... 422/98

* cited by examiner

ELECTRIC POTENTIAL SHAPING APPARATUS FOR HOLDING A SEMICONDUCTOR WAFER DURING ELECTROPLATING

CROSS REFERENCE TO RELATED APPLICATION

This application is a divisional of application Ser. No. 08/970,120, filed Nov. 13, 1997 now U.S. Pat. No. 6,159,354 entitled "Electric Potential Shaping Apparatus for Holding a Semiconductor Wafer During Electroplating".

This application is related to Patton et al., co-filed application Ser. No. 08/969,984, Reid et al., co-filed application Ser. No. 08/969,267, and Reid et al., co-filed application Ser. No. 08/969,196, all filed Nov. 13, 1997 and still pending all of which are incorporated herein by reference in their entirety.

FIELD OF INVENTION

The present invention relates generally to an apparatus for treating the surface of a substrate and more particularly to an apparatus for electroplating a layer on a semiconductor wafer.

BACKGROUND OF THE INVENTION

The manufacture of semiconductor devices often requires the formation of electrical conductors on semiconductor wafers. For example, electrically conductive leads on the wafer are often formed by electroplating (depositing) an electrically conductive layer such as copper on the wafer and into patterned trenches.

Electroplating involves making electrical contact with the wafer surface upon which the electrically conductive layer is to be deposited (hereinafter the "wafer plating surface"). Current is then passed through a plating solution (i.e. a solution containing ions of the element being deposited, for example, a solution containing $Cu^{++}$) between an anode and the wafer plating surface (the wafer plating surface being the cathode). This causes an electrochemical reaction on the wafer plating surface which results in the deposition of the electrically conductive layer.

To minimize variations in characteristics of the devices formed on the wafer, it is important that the electrically conductive layer be deposited uniformly (have a uniform thickness) over the wafer plating surface. However, conventional electroplating processes produce nonuniformity in the deposited electrically conductive layer due to the "edge effect" described in Schuster et al., U.S. Pat. No. 5,000,827, herein incorporated by reference in its entirety. The edge effect is the tendency of the deposited electrically conductive layer to be thicker near the wafer edge than at the wafer center.

To offset the edge effect, Schuster et al. teaches non-laminar flow of the plating solution in the region near the edge of the wafer, i.e. teaches adjusting the flow characteristics of the plating solution to reduce the thickness of the deposited electrically conductive layer near the wafer edge. However, the range over which the flow characteristics can be adjusted is limited and difficult to control. Thus, it is desirable to have a method of offsetting the edge effect which does not rely on adjustment of the flow characteristics of the plating solution.

Another conventional method of offsetting the edge effect is to make use of "thieves" adjacent the wafer. By passing electrical current between the thieves and the anode during the electroplating process, electrically conductive material is deposited on the thieves which otherwise would have been deposited on the wafer plating surface near the wafer edge where the thieves are located. This improves the uniformity of the deposited electrically conductive layer on the wafer plating surface. However, since electrically conductive material is deposited on the thieves, the thieves must be removed periodically and cleaned adding to the maintenance cost and downtime of the apparatus. Further, additional power supplies must be provided to power the thieves adding to the capital cost of the apparatus. Accordingly, it is desirable to avoid the use of thieves.

Nonuniformity of the deposited electrically conductive layer can also result from entrapment of air bubbles on the wafer plating surface. The air bubbles disrupt the flow of ions and electrical current to the wafer plating surface creating nonuniformity in the deposited electrically conductive layer. One conventional method of reducing air bubble entrapment is to immerse the wafer vertically into the plating solution. However, mounting the wafer vertically adds complexity and hinders automation of the electroplating process. Accordingly, it is desirable to have an apparatus for electroplating a wafer which allows the wafer to be immersed horizontally into the plating solution and yet avoids air bubble entrapment.

SUMMARY OF THE INVENTION

In accordance with the present invention, an apparatus for depositing an electrically conductive layer on the surface of a substrate such as a wafer comprises a flange. The flange has a cylindrical wall and an annulus extending inward from the cylindrical wall, the annulus having an inner perimeter which defines a flange central aperture. The apparatus also includes a cup for supporting the wafer along a peripheral region thereof. The cup has a cup central aperture defined by an inner perimeter of the cup, the cup being positioned above the flange.

In one embodiment, the diameter of the flange central aperture is less than the diameter of the cup central aperture. The annulus of the flange thus extends under the edge region of the wafer surface and reduces the electric current flux to this edge region during electroplating. This, in turn, reduces the thickness of the deposited electrically conductive layer on the edge region of the wafer surface. Of importance, the thickness of the deposited electrically conductive layer on the edge region of the wafer surface is reduced without the use of thieves.

The thickness of the deposited electrically conductive layer on the edge region of the wafer can be varied by adjusting the diameter of the flange central aperture. To further decrease the thickness of the layer in this region, the diameter of the flange central aperture is decreased; conversely, to increase the thickness of the layer, the diameter is increased. Thus, the thickness profile of the deposited electrically conductive layer across the wafer surface can be readily adjusted by simply modifying the diameter of the flange central aperture.

The flange can further include a plurality of apertures extending through the cylindrical wall of the flange. By locating these apertures adjacent the cup and near the edge region of the wafer surface, air bubbles entrapped on the wafer surface can readily escape through the apertures. To further enhance removal of entrapped air bubbles, the wafer can be rotated while the plating solution is directed towards the center of the wafer surface.

By modifying the width of the apertures in the cylindrical wall of the flange, the electric current flux at the edge region of the wafer surface is adjusted. This, in turn, adjusts the thickness of the deposited electrically conductive layer on the edge region of the wafer surface. Thus, the thickness profile of the deposited electrically conductive layer across the wafer surface can also be readily adjusted by simply modifying the width of the apertures in the cylindrical wall of the flange.

In accordance with another embodiment of the present invention, a method of depositing an electrically conductive layer on the wafer surface includes providing a cup attached to a flange, the cup having an inner perimeter which defines a cup central aperture, the flange having an annulus. The wafer is then mounted in the cup so that the wafer surface is exposed through the cup central aperture. The cup and flange are then placed into a plating solution, the plating solution contacting the wafer surface. An electrical field and electric current flux is then produced between the wafer surface and an anode in the plating solution wherein the annulus of the flange shapes the electric current flux and reduces the thickness of the deposited electrically conductive layer on the edge region of the wafer surface.

These and other objects, features and advantages of the present invention will be more readily apparent from the detailed description of the preferred embodiments set forth below taken in conjunction with the accompanying drawings.

DETAILED DESCRIPTION OF THE PREFERRED EMBODIMENTS

Several elements in the following figures are substantially similar. Therefore similar reference numbers are used to represent similar elements.

Figure 1:
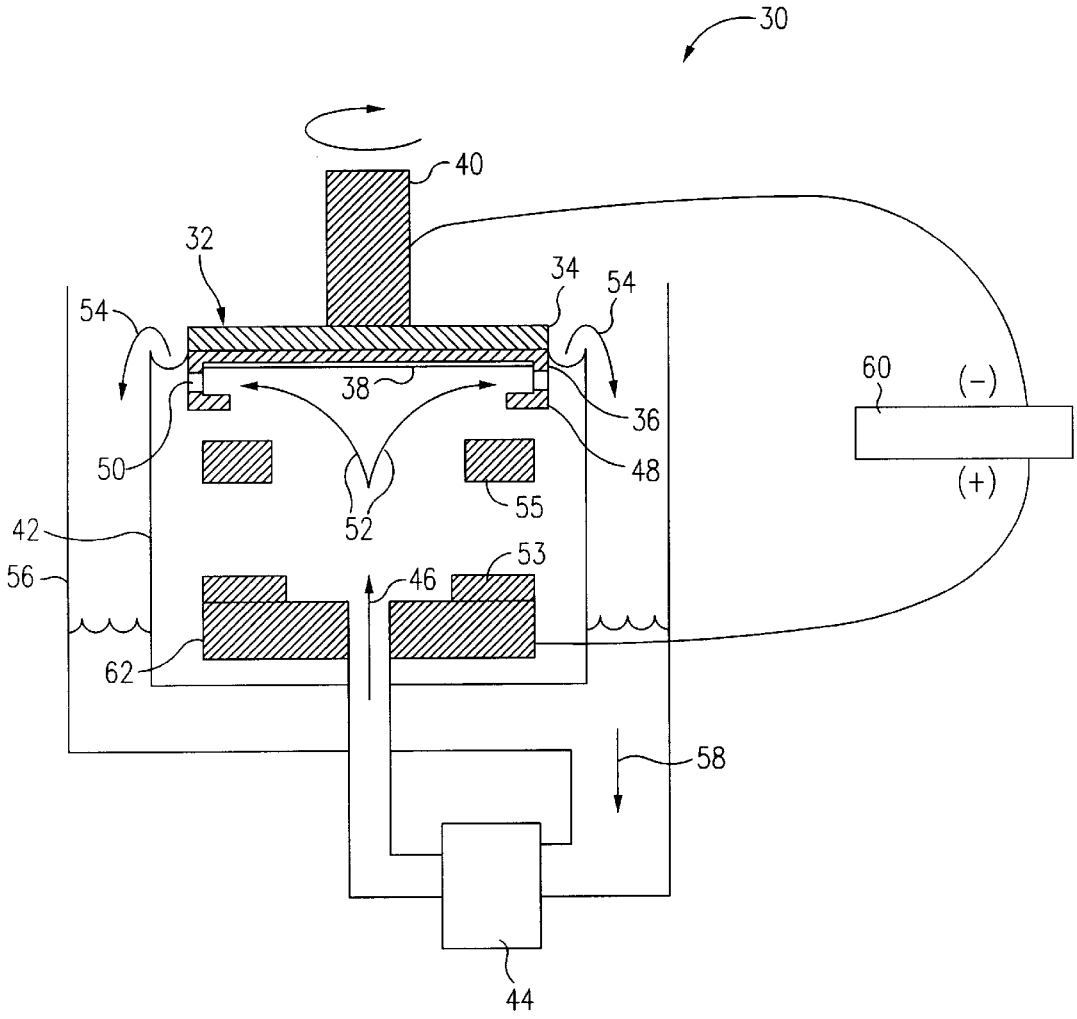
FIG. 1 is a diagrammatical view of an electroplating apparatus having a wafer mounted therein in accordance with the present invention.

FIG. 1 is a diagrammatical view of an electroplating apparatus 30 having a wafer 38 mounted therein in accordance with the present invention. Apparatus 30 includes a clamshell 32 mounted on a rotatable spindle 40 which allows rotation of clamshell 32. Clamshell 32 comprises a cone 34, a cup 36 and a flange 48. Flange 48 has formed therein a plurality of apertures 50. A clamshell lacking a flange 48 yet in other regards similar to clamshell 32 is described in detail in Patton et al., co-filed Application Ser. No. 08/969,984, cited above.

During the electroplating cycle, wafer 38 is mounted in cup 36. Clamshell 32 and hence wafer 38 are then placed in a plating bath 42 containing a plating solution. As indicated by arrow 46, the plating solution is continually provided to plating bath 42 by a pump 44. Generally, the plating solution flows upwards to the center of wafer 38 and then radially outward and across wafer 38 through apertures 50 as indicated by arrows 52. Of importance, by directing the plating solution towards the center of wafer 38, any gas bubbles entrapped on wafer 38 are quickly removed through apertures 50. Gas bubble removal is further enhanced by rotating clamshell 32 and hence wafer 38.

The plating solution then overflows plating bath 42 to an overflow reservoir 56 as indicated by arrows 54. The plating solution is then filtered (not shown) and returned to pump 44 as indicated by arrow 58 completing the recirculation of the plating solution.

A DC (or pulsed) power supply 60 has a negative output lead electrically connected to wafer 38 through one or more slip rings, brushes and contacts (not shown). The positive output lead of power supply 60 is electrically connected to an anode 62 located in plating bath 42. During use, power supply 60 biases wafer 38 to have a negative potential relative to anode 62 causing an electrical current to flow from anode 62 to wafer 38. (As used herein, electrical current flows in the same direction as the net positive ion flux and opposite the net electron flux.) This causes an electrochemical reaction (e.g. $Cu^{++}+2e=Cu$) on wafer 38 which results in the deposition of the electrically conductive layer (e.g. copper) on wafer 38. The ion concentration of the plating solution is replenished during the plating cycle, for example by dissolving a metallic anode (e.g. $Cu=Cu^{++}+2e^{-}$). Shields 53 and 55 are provided to shape the electric field between anode 62 and wafer 38. The use and construction of anodes and shields are further described in Reid et al., co-filed application Ser. No. 08/969,196 and Reid et al., co-filed application Ser. No. 08/969,267, both cited above.

Figure 2A:
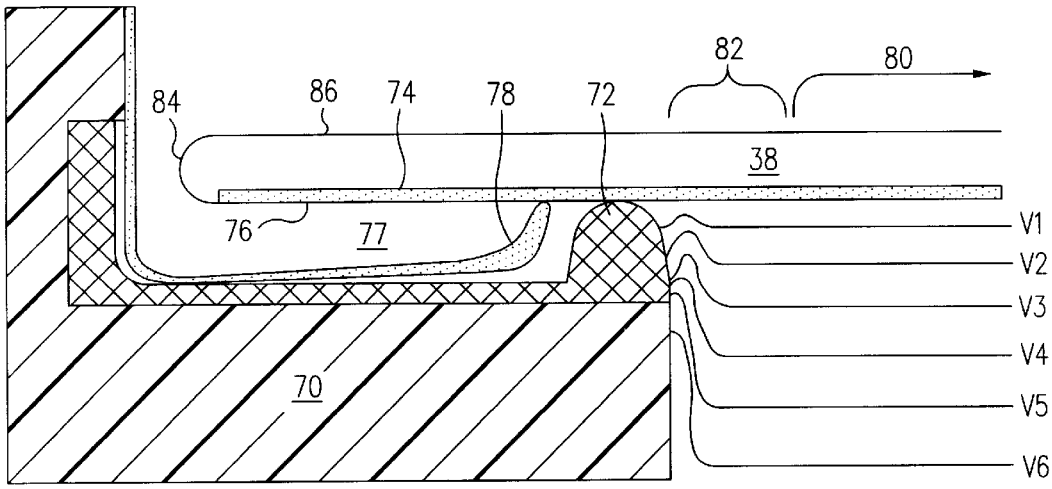
FIGS. 2A and 2B are cross-sectional views of a cup having a wafer mounted therein illustrating equipotential surfaces and electric current flux lines, respectively, during electroplating in accordance with the related art.
Figure 2B:
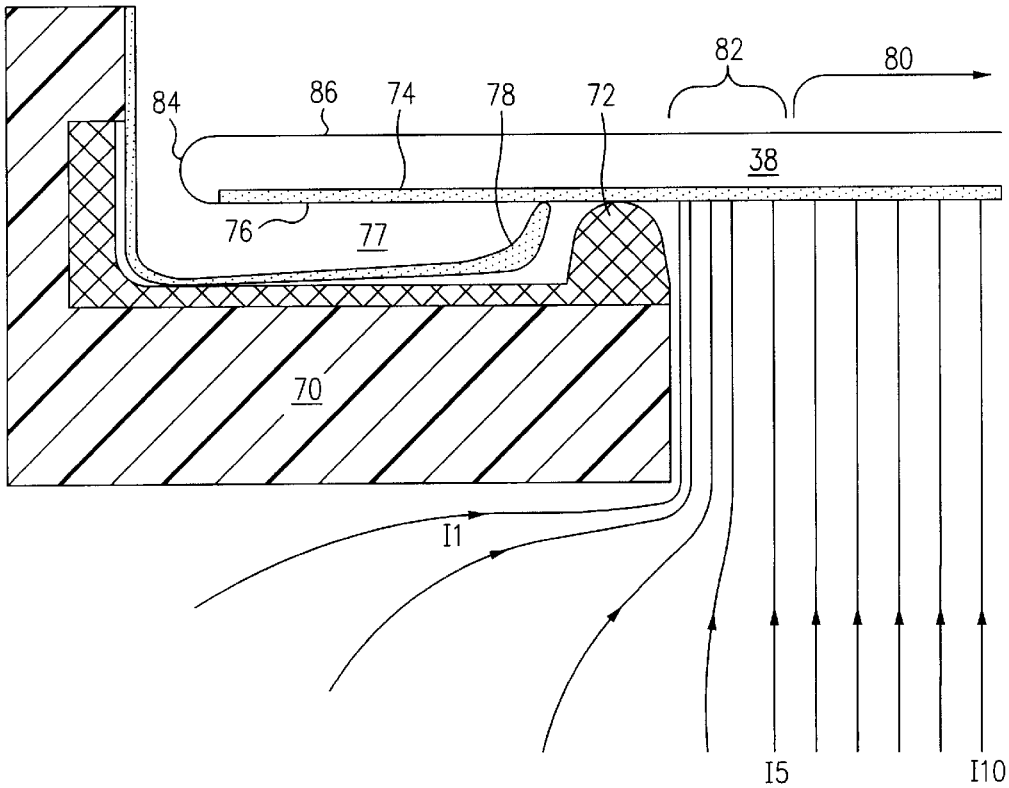

FIGS. 2A and 2B are cross-sectional views of a cup 70 having a wafer 38 mounted therein illustrating equipotential surfaces and electric current flux lines, respectively, during electroplating in accordance with the related art. A cup similar to cup 70 is described in detail in Patton et al., co-filed application Ser. No. 08/969,984, cited above. For purposes of clarity, the plating solution and anode are not illustrated in FIGS. 2A and 2B but it is understood that cup 70 including wafer 38 is immersed in a plating solution and that an electrical potential (a voltage differential) exists between a conventional electrically conductive seed layer 74 on a plating surface 76 of wafer 38 and the anode (See anode 62 in FIG. 1). Copper on titanium nitride or on tantalum are examples of suitable electrically conductive seed layers.

Referring to FIGS. 2A and 2B, cup 70 is fitted with a compliant seal 72 which forms a seal between cup 70 and plating surface 76. Electrical contacts 78 make the electrical connection with seed layer 74 (electrical contacts 78 are electrically connected to the negative output of a power supply, e.g. see power supply 60 of FIG. 1). By forming a seal between cup 70 and plating surface 76, compliant seal 72 prevents the plating solution from entering a region 77 and contaminating contacts 78, wafer edge 84 and wafer backside 86.

In FIG. 2A, equipotential surfaces V1, V2, V3, V4, V5 and V6 represent surfaces of constant electrical potential within the plating solution. Since seed layer 74 is biased with a negative potential compared to the anode, equipotential surface V1 has the most negative potential and the electrical potential increases (becomes less negative) from equipotential surface V1 to equipotential surface V6.

As shown in FIG. 2A, under central region 80 of plating surface 76 of wafer 38, equipotential surfaces V1 through V6 are substantially parallel to one another demonstrating the uniformity of the electric current flux under central region 80. However under edge region 82 of plating surface 76 of wafer 38 (directly adjacent compliant seal 72), equipotential surface V1 to V6 are bunched together and are moved upwards towards wafer 38 demonstrating nonuniformity of the electric current flux under edge region 82.

Referring now to FIG. 2B, electric current flux lines I1 to I10 are illustrated, although for clarity only flux lines I1, I5 and I10 are labeled. The density of the flux lines at any particular region (the number per unit area perpendicular to the flux lines) is proportional to the magnitude of the electric current flux at the particular region. As shown in FIG. 2B, the spacing between flux lines I5 to I10 under central region 80 is substantially uniform as is the magnitude of the electric current flux. However flux lines I1 to I5 under edge region 82 are spaced closer together than flux lines I5 to I10 indicating that the magnitude of the electric current flux under edge region 82 is greater than under central region 80. Flux lines I1 to I5 are spaced together since cup 70 is formed of, or alternatively coated with, a dielectric which shapes the electric current flux. Since the electric current flux per unit area is proportional to the number of flux lines entering the unit area, the electric current flux per unit area of edge region 82 is greater than the electric current flux per unit area of central region 80. Since the amount of electrically conductive material deposited per unit area is directly related to the electric current flux per unit area, the thickness of the electrically conductive layer deposited on plating surface 76 is thickest on edge region 82.

Figure 10A:
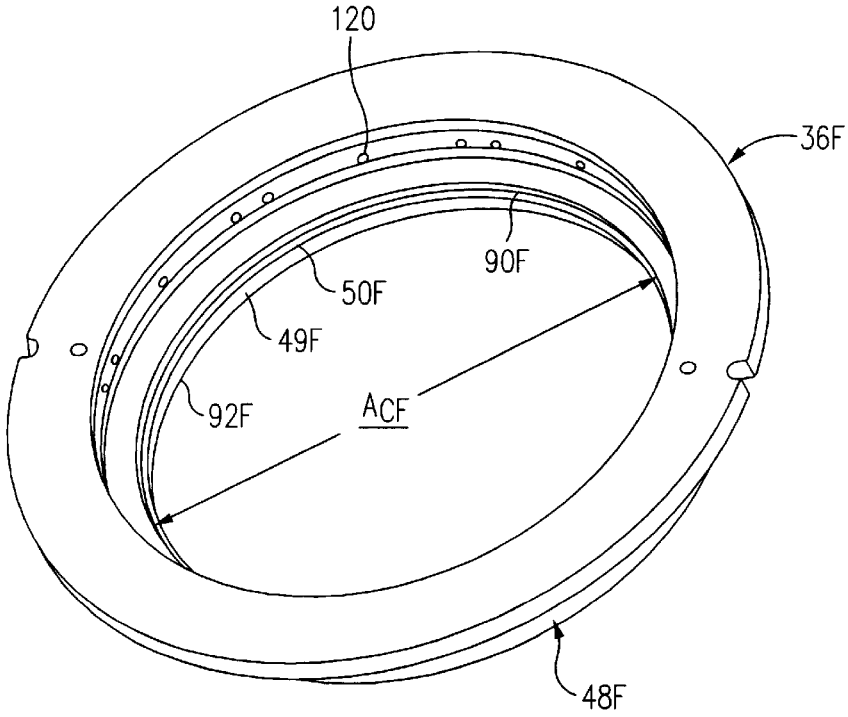
FIGS. 10A and 10B are top and bottom perspective views, respectively, of a cup formed integrally with a flange in accordance with the present invention.
Figure 10B:
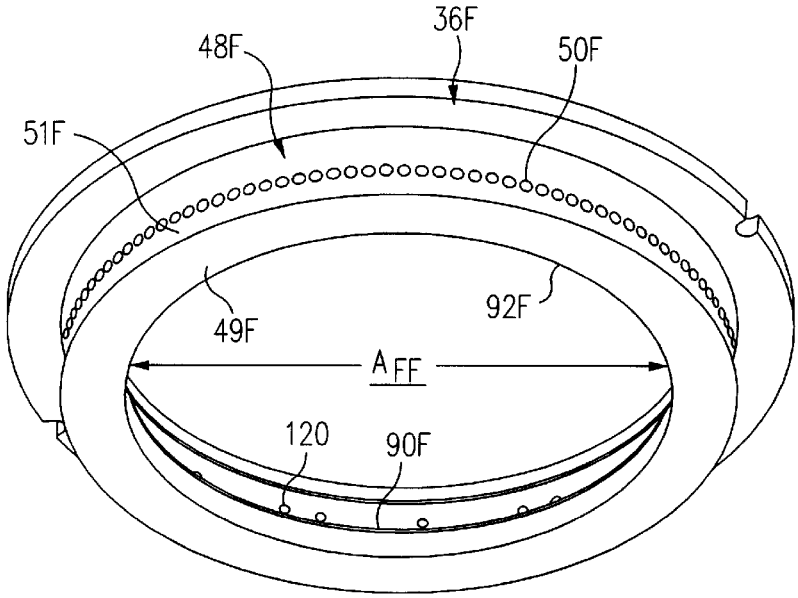

FIGS. 10A and 10B are top and bottom perspective views, respectively, of a cup 36F formed integrally with a flange 48F in accordance with the one embodiment of the present invention. As best shown in FIG. 10B, flange 48F comprises a vertical cylindrical wall 51F and an annulus 49F. More particularly, a first end of wall 51F is integrally attached to cup 36F and a second end of wall 51F is integrally attached to annulus 49F. Extending from the inner cylindrical surface to the outer cylindrical surface of wall 51F are a plurality of apertures 50F which are circular holes. The advantages of flange 48F are similar to the advantages discussed below in regards to flange 48A of FIGS. 3A and 3B.

Figure 3A:
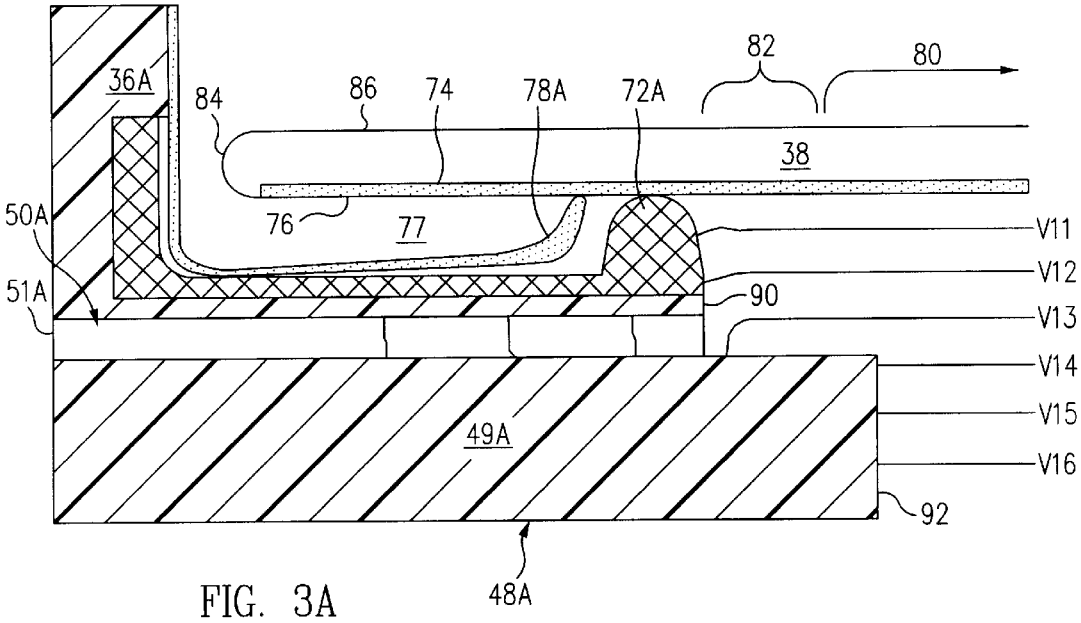
FIGS. 3A and 3B are cross-sectional views of a flange and a cup having a wafer mounted therein illustrating equipotential surfaces and electric current flux lines, respectively, during electroplating in accordance with the present invention.
Figure 3B:
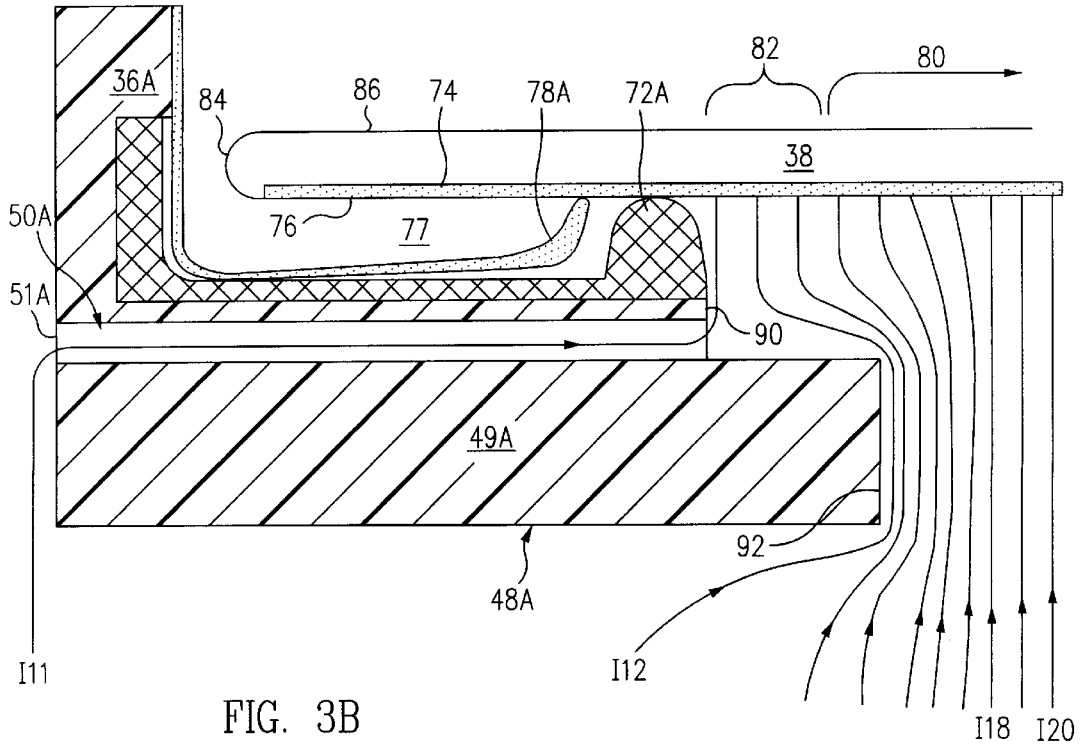

FIGS. 3A and 3B are cross-sectional views of a cup 36A having a wafer 38 mounted therein and a flange 48A integral with cup 36A illustrating equipotential surfaces and electric current flux lines, respectively, during electroplating in accordance with the present invention. For purposes of clarity, the plating solution and anode are not illustrated in FIGS. 3A and 3B but it is understood that cup 36A including wafer 38 and flange 48A are immersed in a plating solution and that an electrical potential exists between seed layer 74 and the anode.

In accordance with this embodiment, flange 48A includes an annulus 49A which horizontally extends inward beyond inner perimeter 90 of cup 36A. Thus, annulus 49A has an inner perimeter 92 which defines a flange central aperture having a diameter less than the cup central aperture defined by inner perimeter 90 of cup 36A. Flange 48A and cup 36A are formed from a dielectric material or alternatively, from an electrically conductive material having an insulative coating. For example, flange 48A and cup 36A are formed of an electrically insulating material such as polyvinylidene fluoride (PVDF) or chlorinated polyvinyl chloride (CPVC). Instead of forming flange 48A integrally with cup 36A, flange 48A can also be formed separately from cup 36A and then attached to cup 36A. For example, flange 48A can be bolted to cup 36A.

Extending horizontally (substantially parallel to the plane defined by inner perimeter 90 of cup 36A) and through a vertical cylindrical wall 51A of flange 48A are a plurality of apertures 50A. By locating apertures 50A adjacent cup 36A and near edge region 82 of plating surface 76, any gas bubbles entrapped on plating surface 76 are readily released through apertures 50A.

Referring to FIG. 3A, equipotential surfaces V11, V12, V13, V14, V15 and V16 representing surfaces of constant electric potential within the plating solution are illustrated. Equipotential surface V11 has the most negative potential and the electrical potential increases from equipotential surface V11 to equipotential surface V16. The substantially uniform spacing between equipotential surfaces V11 to V16 demonstrates the uniformity of the electric current flux near wafer 38. Of importance, the equipotential surfaces V11, V12 and V13 have substantially uniform spacing under both edge region 82 and central region 80 thus demonstrating the uniformity of the electric current flux in these regions.

Referring now to FIG. 3B, electric current flux lines I11 to I20 are illustrated although for clarity only flux lines I11, I12, I18 and I20 are labeled. As shown in FIG. 3B, the spacing between flux lines I12 to I18 is reduced adjacent inner perimeter 92 of annulus 49A indicating a greater magnitude of the electric current flux in this region. However, flux lines I12 to I18 spread from annulus 49A to plating surface 76 and are substantially uniformly spaced at plating surface 76. Flux line I11 extends through aperture 50A thus contributing to the magnitude of the electric current flux at edge region 82. Flux lines I18 to I20 are uniformly spaced from one another and are substantially unaffected by annulus 49A and cup 36A.

Of importance, flux lines I11 to I20 are substantially uniformly spaced at plating surface 76 in both edge region 82 and central region 80. Thus the magnitude of the electric current flux at plating surface 76 is uniform. Since the amount of electrically conductive material deposited per unit area of plating surface 76 is directly related to the electric current flux per the unit area, the thickness of the deposited electrically conductive layer on plating surface 76 is substantially uniform. In one embodiment, the thickness uniformity of the deposited electrically conductive layer is within 2%, i.e. the thickness of the deposited electrically conductive layer at any given point is within 2% of the average thickness of the deposited electrically conductive layer.

FIGS. 4, 5, 6 and 7 are cross-sectional views of cups formed integrally with various flanges in accordance with alternative embodiments of the present invention. For clarity, the cones (see cone 34 of FIG. 1) are not illustrated in FIGS. 4, 5, 6 and 7.

Figure 4:
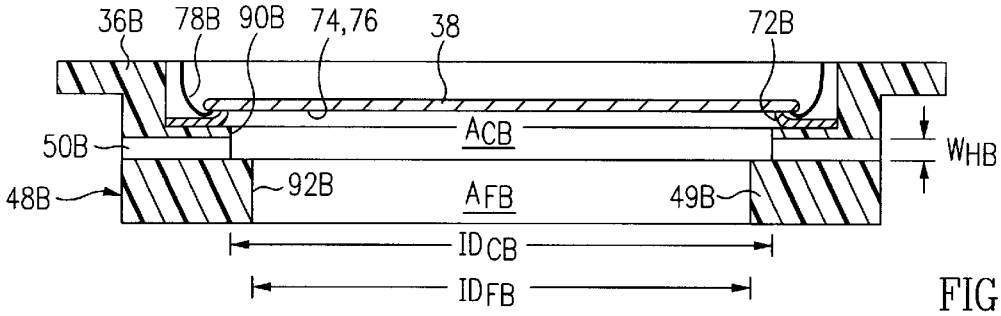
FIGS. 4, 5, 6 and 7 are cross-sectional views of cups formed integrally with various flanges in accordance with alternative embodiments of the present invention.

Referring to FIG. 4, a wafer 38 is mounted in a cup 36B. Wafer 38 is pressed down on to compliant seal 72B by a cone (not shown). This forms the electrical connection between contacts 78B and seed layer 74 on plating surface 76. As shown in FIG. 4, cup 36B has an inner perimeter 90B which defines a cup central aperture $A_{CB}$ having a diameter $ID_{CB}$. Flange 48B has an annulus 49B having an inner perimeter 92B which defines a flange central aperture $A_{FB}$ having a diameter $ID_{FB}$. Since diameter $ID_{FB}$ is less than diameter $ID_{CB}$, annulus 49B extends under the edge region of plating surface 76 effectively shielding the edge region, i.e. flange 483 reduces the electric current flux to the edge region of plating surface 76. This, in turn, reduces the thickness of the deposited electrically conductive layer on the edge region of plating surface 76.

Figure 5:
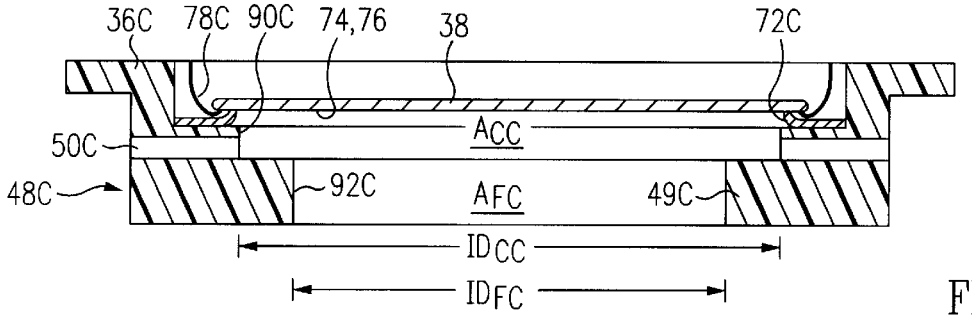

Referring now to FIG. 5, cup 36C is substantially similar to cup 36B (FIG. 4). However, in the FIG. 5 embodiment, the annulus 49C of flange 48C extends further under the edge region towards the center of plating surface 76 than does annulus 49B (FIG. 4). Thus, flange 48C shields more of the edge region of plating surface 76 than does flange 48B.

Figure 8:
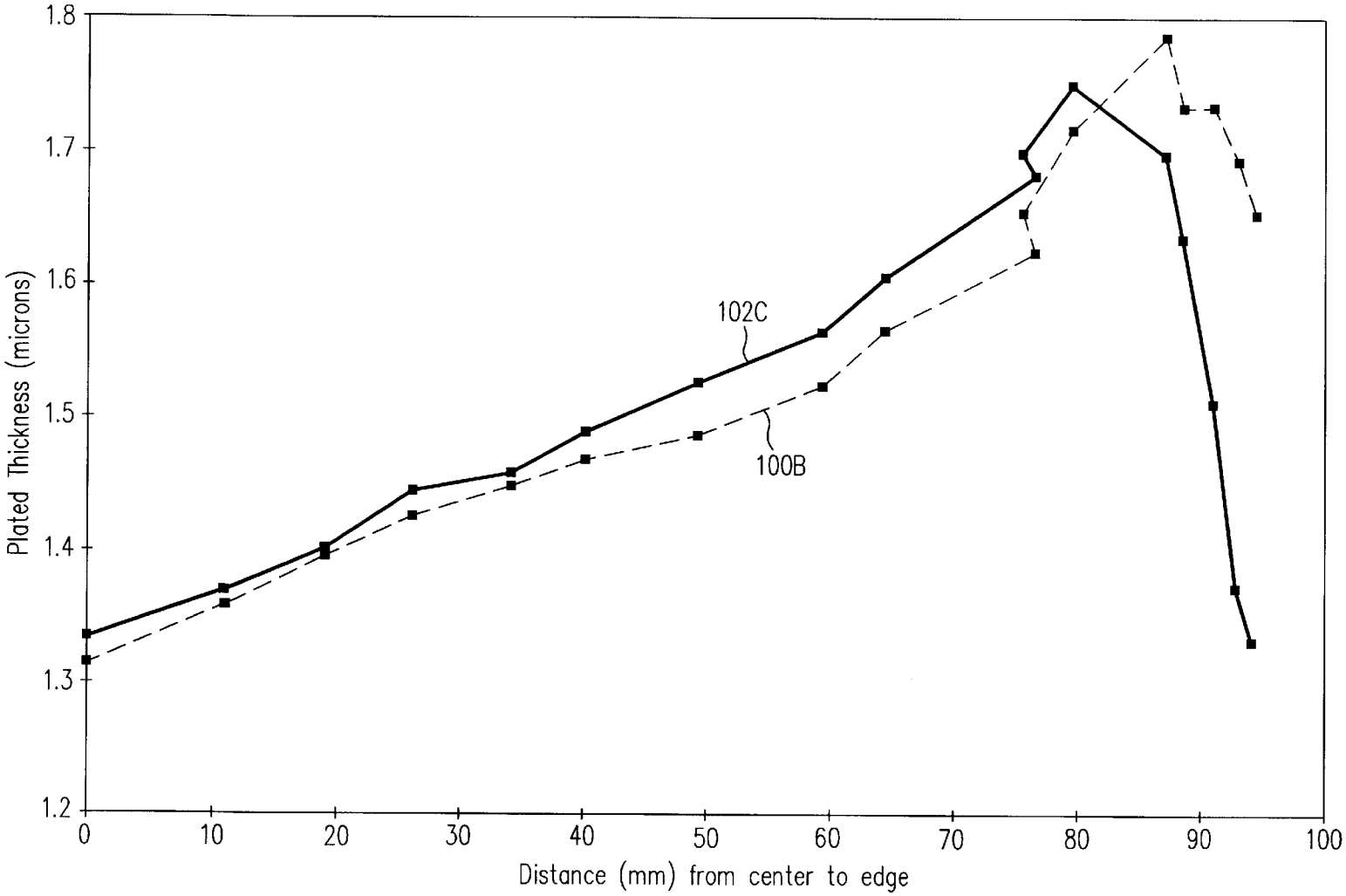
FIGS. 8 and 9 are graphs of the plated thickness versus distance from the wafer center for various flanges in accordance with the present invention.

FIG. 8 is a graph of the resulting thickness in microns ($\mu$m) of the deposited electrically conductive layer (the "plated thickness") versus distance in millimeters (mm) from the center of wafer 38 for flanges 48B and 48C in accordance with the present invention. More particularly, trace 100B is for flange 48B (FIG. 4) where the inner diameter $ID_{FB}$ of annulus 49B is 7.33 inch (18.62 cm.) and trace 102C is for flange 48C (FIG. 5) where the inner diameter IDFC of annulus 49C is 7.13 in. (18.11 cm.). As shown in FIG. 8, the plated thickness gradually increases from about 1.32 $\mu$m at the wafer center to about 1.73 $\mu$m at about 80 mm from the wafer center in both traces 100B and 102C. The plated thickness for trace 102C then decreases to about 1.35 $\mu$m at about 93 mm from the wafer center. This abrupt falloff of plated thickness at the edge region results from the relatively large shielding effect of flange 48C. In contrast, the plated thickness for trace 100B decreases only slightly from about 1.78 $\mu$m at about 87 mm from the wafer center to about 1.65 $\mu$m at about 93 mm from the wafer center. Without flanges 48B, 48C, traces 100B, 102C, respectively, would not fall off (would not have a negative slope) at the edge region of the wafer.

As shown by traces 102C, 100B, the plated thickness profile across the plating surface is readily adjusted by simply modifying the inner diameter of the flange. More particularly, by decreasing the inner diameter of the flange the plated thickness on the edge region is reduced; conversely, by increasing the inner diameter of the flange the plated thickness of the edge region is increased.

Figure 6:
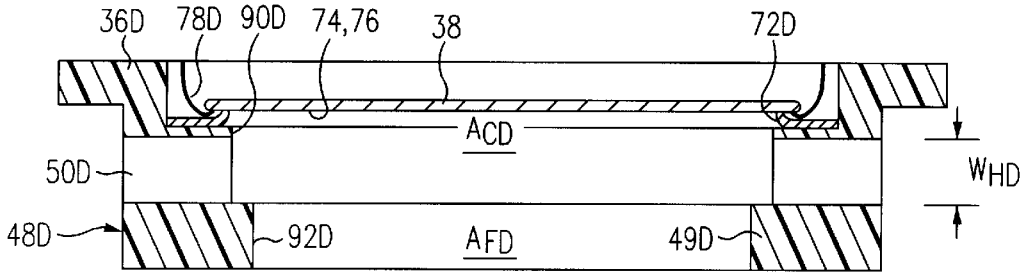
Figure 7:
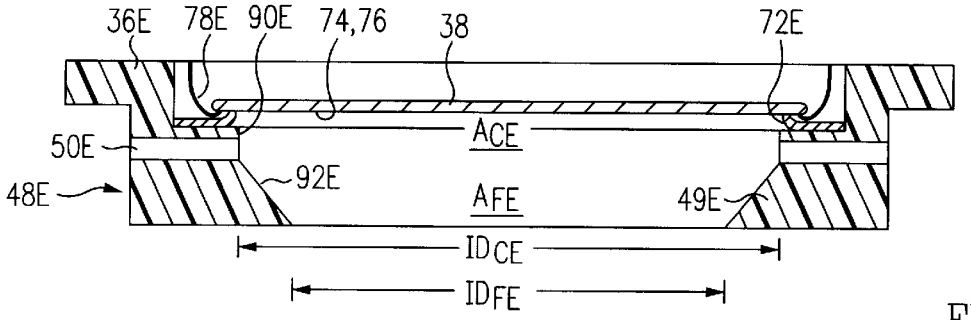

Referring now to FIG. 6, cup 36D is substantially similar to cup 36B (FIG. 4). However, in the FIG. 6 embodiment, the width $W_{HD}$ of apertures 50D extending through flange 48D is greater than the width $W_{HB}$ of apertures 50B extending through flange 48B. Forming flange 48D with apertures 50D having a greater width $W_{HD}$ increases the electric current flux through apertures 50D (see flux line Ill in FIG. 3B). Increasing the electric current flux results in a greater plating thickness on the edge region of wafer plating surface 76.

Figure 9:
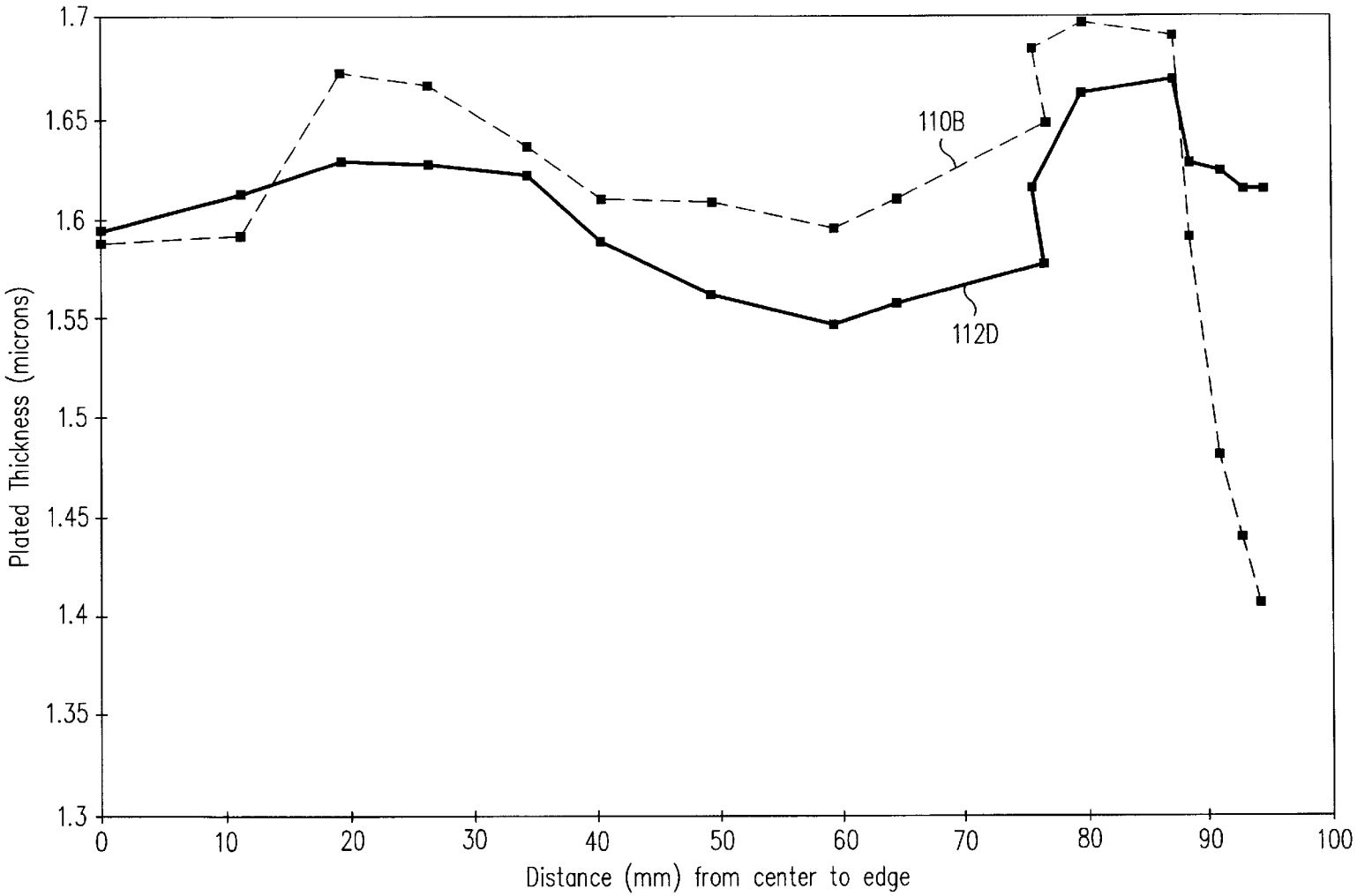

FIG. 9 is a graph of the resulting plated thickness in microns versus distance in millimeters from the center of wafer 38 for flanges 48B and 48D in accordance with the present invention. More particularly, trace 110B is for flange 48B (FIG. 4) having apertures 50B with widths $W_{HB}$ equal to 0.05 in. (0.13 cm.) and trace 112D is for flange 48D (FIG. 6) having apertures 50D with widths $W_{HD}$ equal to 0.10 in. (0.25 cm.).

As shown in FIG. 9, at about 85 mm from the wafer center the plating thickness of trace 110B decreases abruptly from about 1.68 $\mu$m to about 1.42 $\mu$m at about 93 mm from the wafer center due to the shielding of the edge region of plating surface 76 from flange 48B. In contrast, as shown by trace 112D, the plating thickness only decreases slightly over this same edge region from approximately 1.67 $\mu$m to 1.62 $\mu$m due to the increased electric current flux through apertures 50D. (Note that the anode to wafer spacing was greater by approximately 1.0 cm in FIG. 8 than in FIG. 9 thus accounting for the differences in traces 100B, 110B of FIGS. 8, 9, respectively.)

Thus, as shown by traces 110B, 112D in FIG. 9, the plated thickness profile across the plating surface is readily adjusted by simply modifying the width of the apertures in the flange. More particularly, by increasing the width of the apertures in the flange the plated thickness on the edge region is increased; conversely, by decreasing the width of the apertures in the flange the plated thickness on the edge region is decreased. This is a significant advantage over the prior art in which the severe limitations of adjusting the flow characteristics of the plating solution limits adjustment of the plated thickness profile.

Referring again to FIGS. 4, 5 and 6, annuluses 49B, 49C and 49D have inner perimeters 92B, 92C and 92D which are surfaces perpendicular to the planes defined by flange central apertures $A_{FB}$, $A_{FC}$, $A_{FD}$, respectively (i.e. inner perimeters 92B, 92C and 92D are perpendicular to the plane defined by wafer plating surface 76). In contrast, referring now to FIG. 7, annulus 49E of flange 48E has an inner perimeter 92E sloped relative to the plane defined by flange central aperture $A_{FE}$. More particularly, inner perimeter 92E flares inward from a first diameter equal to inner diameter $ID_{CE}$ of inner perimeter 90E of cup 36E to a second lesser diameter $ID_{FE}$. This embodiment results in a less abrupt change in the plating thickness at the edge region of plating surface 76 compared to flanges 48B, 48C and 48D of FIGS. 4, 5 and 6, respectively.

FIGS. 10A and 10B are top and bottom perspective views, respectively, of a cup 36F formed integrally with a flange 48F in accordance with another embodiment of the present invention. As shown in FIG. 10A, cup 36F has an inner perimeter 90F which defines a cup central aperture $A_{CF}$. Threaded bolt holes 120 are provided in cup 36F for bolting one or more contact strips to cup 36F. These contact strips are not illustrated in FIGS. 10A and 10B for purposes of clarity.

Referring now to FIG. 10B, flange 48F comprises a vertical cylindrical wall 51F and an annulus 49F. More particularly, a first end of wall 51F is integrally attached to cup 36F and a second end of wall 51F is integrally attached to annulus 49F. Extending from the inner cylindrical surface to the outer cylindrical surface of wall 51F are a plurality of apertures 50F which are circular holes. Annulus 49F has an inner perimeter 92F which defines a flange central aperture $A_{FF}$. Flange central aperture $A_{FF}$ has a diameter less than the diameter of cup central aperture $A_{CF}$ (FIG. 10A) and less than the inner diameter of wall 51F.

Figure 11:
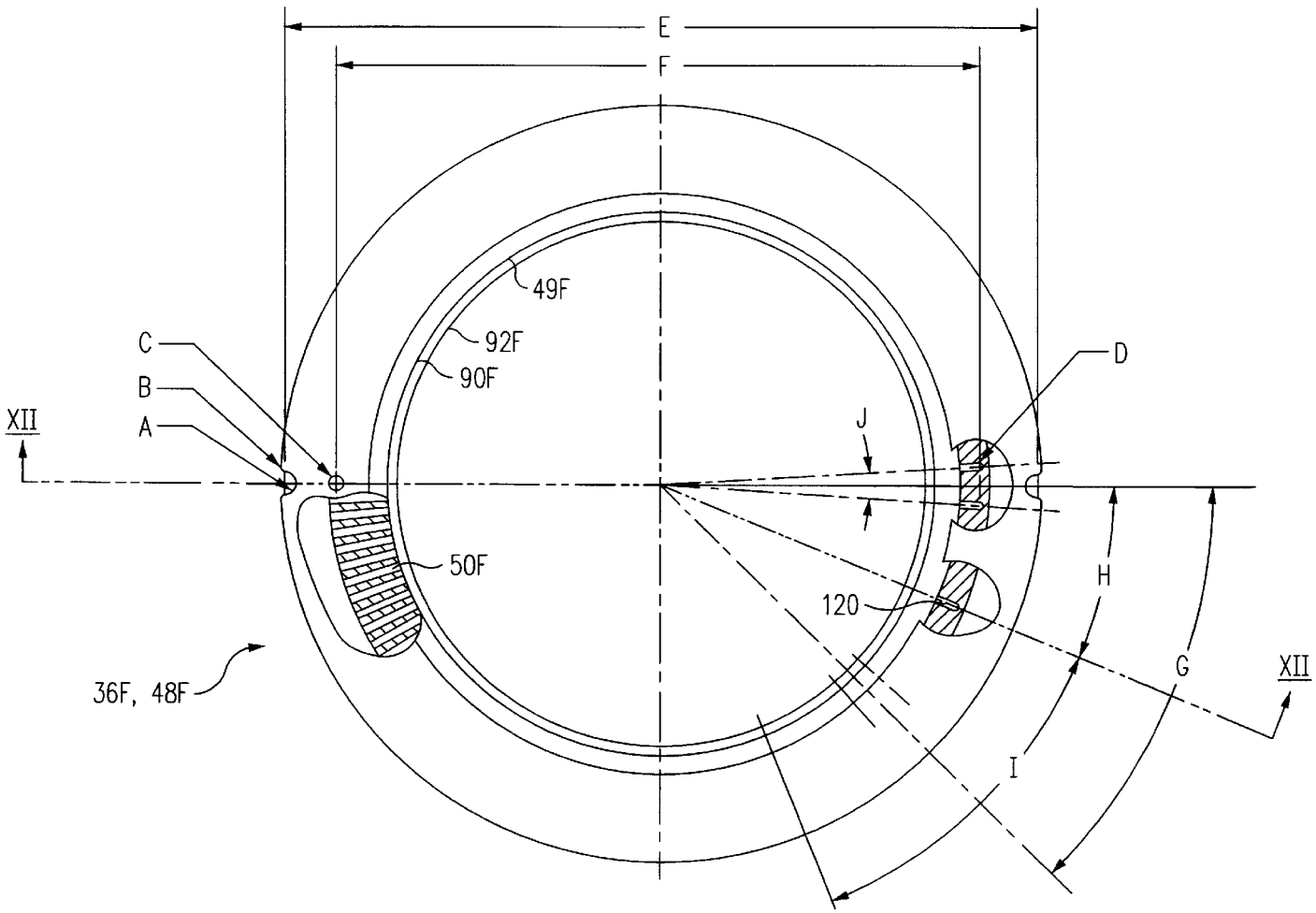
FIG. 11 is a top plan view, partially in section, of the cup and flange of FIGS. 10A and 10B in accordance with this embodiment of the present invention.

FIG. 11 is a top plan view, partially in section, of cup 36F integral with flange 48F in accordance with the FIGS. 10A and 10B embodiment of the present invention. Cup 36F and flange 48F are formed of an electrically insulating material such as CPVC. Illustrative specifications for various characteristics of cup 36F and flange 48F shown in FIG. 11 are provided in Table I below.

TABLE I

| CHARACTERISTIC | DESCRIPTION | SPECIFICATION |
|---|---|---|
| A | registration notch | 2X R .158 In. (180° APART) |
| B | registration notch champfer | 45° × 0.50 In. CHAMPFER, 2 PLCS (BOTH SLOTS) |
| C | alignment pin receptacle | 0.138 In. × .390 In. DP. C'SINK 45° × .030 In. DE. 2 PLCS, 180° APART |
| D | contact mounting holes | DRILL 0.104 In. × .300 In. DP (.340 In. MAX DP. AT DRILL POINT) BOTTOM TAP 6–32 THRD, 24 PLCS |
| E | registration notch center diameter | 10.380 In. |
| F | alignment pin receptacle diameter | 8.860 In. |
| G | contact strip arc | 8X 45.0° |
| H | contact mounting hole arc angles | 22.5° |
| I | contact mounting hole arc angles | 8X 45.0° |
| J | contact mounting hole arc angles | 7.0° |

Figure 12:
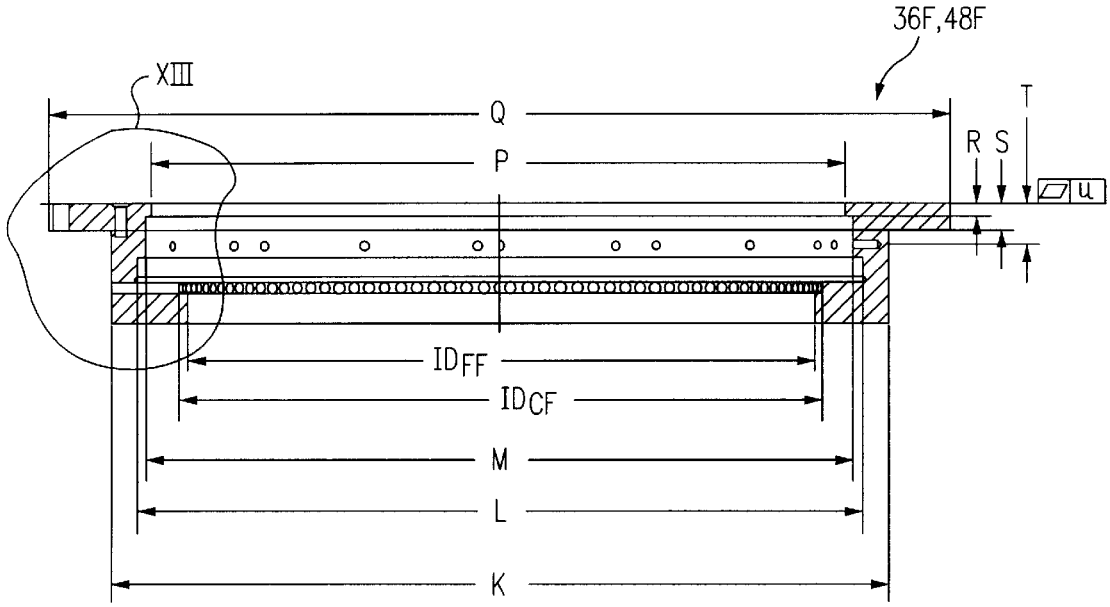
FIG. 12 is a cross-sectional view of the cup and flange taken along the line XII—XII of FIG. 11 in accordance with this embodiment of the present invention.

FIG. 12 is a cross-sectional view of cup 36F and flange 48F taken along the line XII—XII of FIG. 11 in accordance with this embodiment of the present invention. Illustrative specifications for various characteristics of cup 36F and flange 48F shown in FIG. 12 are provided in Table II below.

TABLE II

| CHARACTERISTIC | DESCRIPTION | SPECIFICATION |
|---|---|---|
| K | clamshell OD | 09.080 In. |
| L | wafer seal OD | 08.480 In. |
| M | contact mounting ID | 08.280 In. |
| $ID_{CF}$ | cup central aperture diameter | 01.530 In. |
| $ID_{FF}$ | flange central aperture diameter | 07.330 In. |
| P | cup ID | 08.130 In. |
| Q | cup OD | 010.550 In. |
| R | Inner cup lip height | .150 In. |
| S | cup lip height | .310 In. |
| T | contact mounting hole vertical position | .521 In. |
| U | parallelism | .005 In. |

Figure 13:
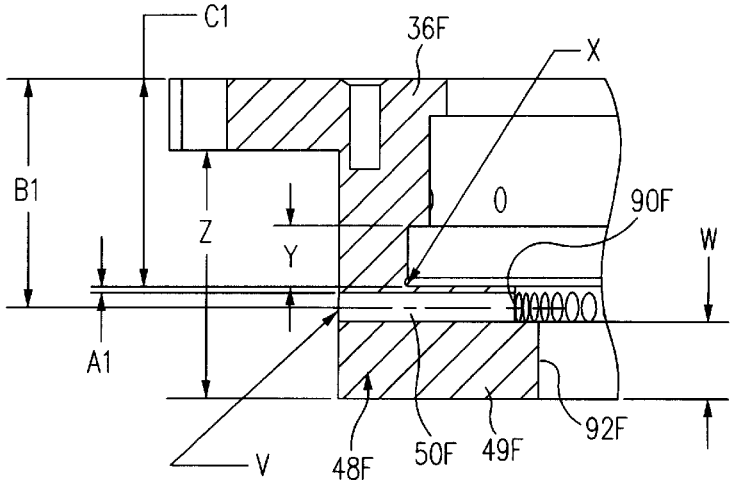
FIG. 13 is a detailed cross-sectional view of a portion XIII from FIG. 12 of the cup and flange in accordance with this embodiment of the present invention.

FIG. 13 is a cross-sectional view of a portion XIII from FIG. 12 of cup 36F and flange 48F in accordance with this embodiment of the present invention. Illustrative specifications for various characteristics of cup 36F and flange 48F shown in FIG. 13 are provided in Table III below.

TABLE III

| CHARACTERISTIC | DESCRIPTION | SPECIFICATION |
|---|---|---|
| V | vent hole diameter | 120 PLCS. 3° APART |
| W | flange height | .353 In. |
| X | wafer seal relief | R. 020 In. × .020 In. DP. |
| Y | contact relief height | .275 In. |
| Z | lower cup height | 1.111 In. |
| A1 | wafer seal to hole distance | .022 In. REF |
| B1 | hole vertical position | 1.005 In. |
| C1 | wafer seal vertical position | .921 In. |

Note that all characteristics in Tables I, II and III are symmetrical and must be concentric with the center bore center line within 0.005 total indicated radius in inches (TIR) and that all edges should be lightly deburred.

Figure 14:
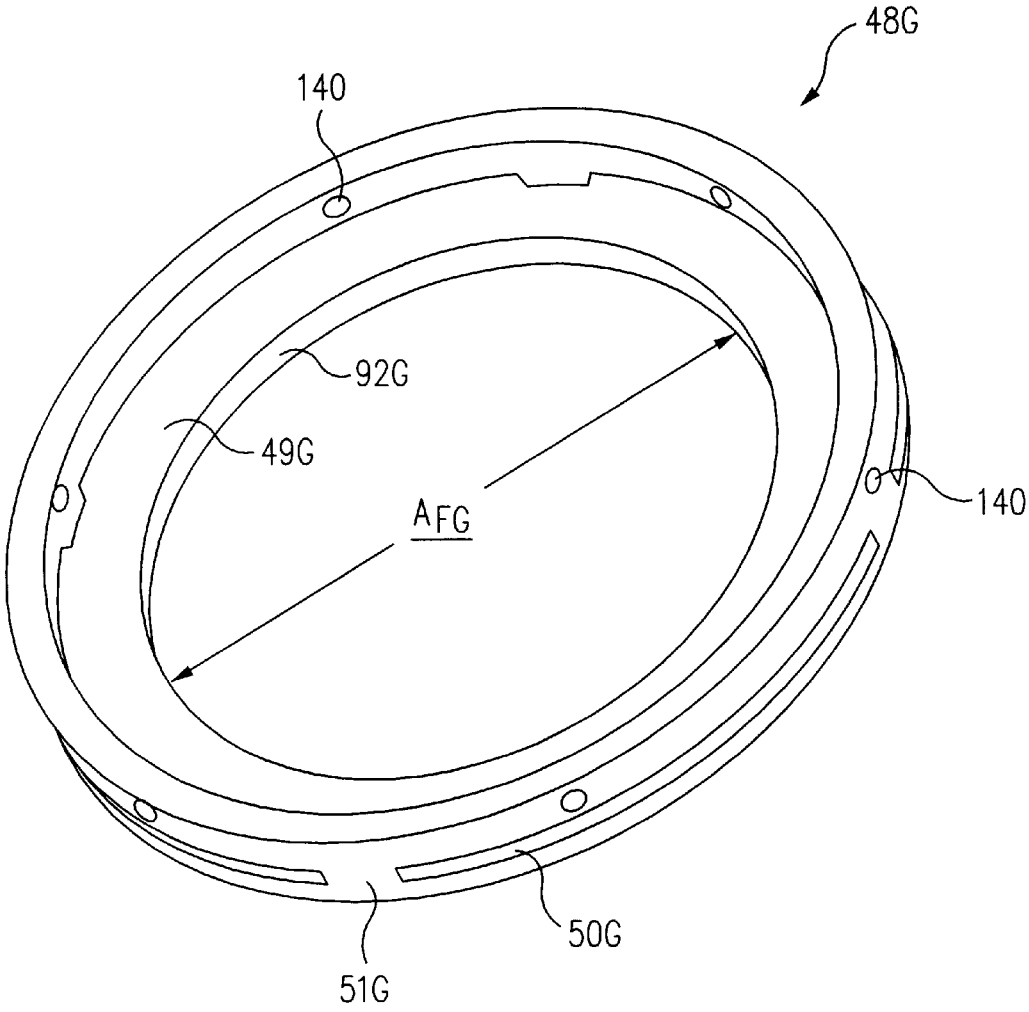
FIG. 14 is a top perspective view of a flange in accordance with an alternative embodiment of the present invention.

FIG. 14 is a top perspective view of a flange 48G in accordance with an alternative embodiment of the present invention. Flange 48G is formed from an electrically insulative material such as PVC. Flange 48G comprises a vertical cylindrical wall 51G and an annulus 49G. Wall 51G is provided with holes 140 for mounting flange 48G to a cup (not shown). Bolts are passed through holes 140 and into the cup to mount flange 48G to the cup. This is in contrast to flange 48F of FIGS. 10A, 10B, 11, 12 and 13 which is formed integrally with cup 36F. Referring still to FIG. 14, wall 51G is formed with four apertures 50G shaped as elongated slots. Directly below apertures 50G and integrally attached to an end of wall 51G is an annulus 49G having an inner perimeter 92G which defines a flange central aperture $A_{FG}$.

Figure 15:
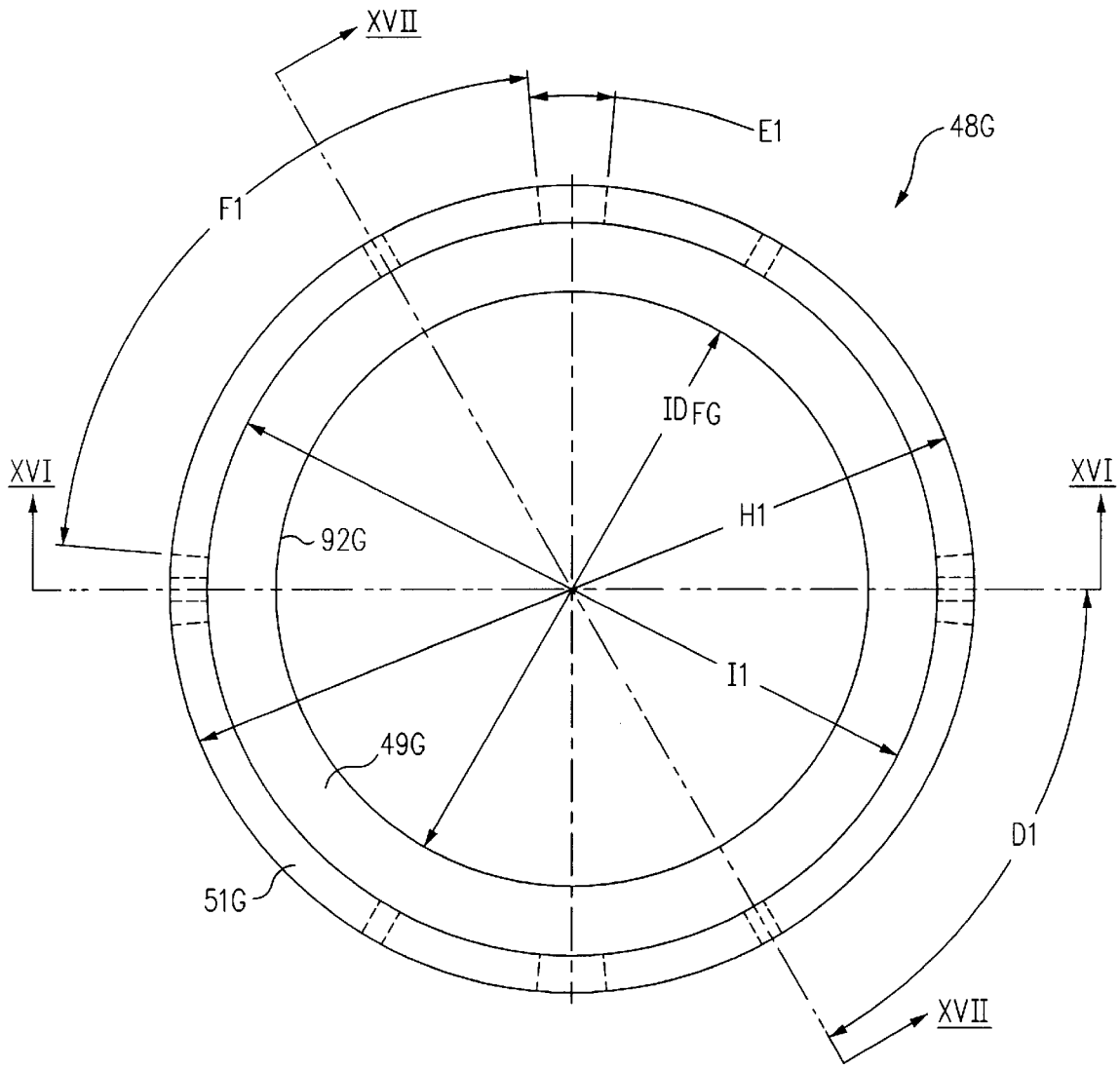
FIG. 15 is a top plan view of the flange of FIG. 14 in accordance with this embodiment of the present invention.

FIG. 15 is a top plan view of flange 48G of FIG. 14 in accordance with this embodiment of the present invention. Illustrative specifications for various characteristics of flange 48G shown in FIG. 15 are provided in Table IV below.

TABLE IV

| CHARACTERISTIC | SPECIFICATION |
|---|---|
| D1 | 6X 60.0° |
| E1 | 4X 10.0° |
| F1 | 4X 80.0° |
| $ID_{FG}$ | 7.33 In. OR 7.13 In. |
| H1 | 010.00 In. |
| I1 | 09.080 In. |

Figure 16:
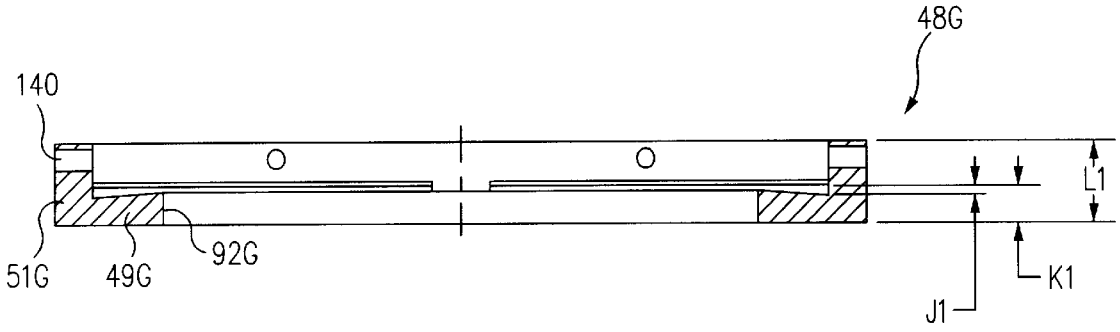
FIG. 16 is a cross-sectional view of the flange taken along the line XVI—XVI of FIG. 15 in accordance with this embodiment of the present invention.

FIG. 16 is a cross-sectional view of flange 48G taken along the line XVI—XVI of FIG. 15 in accordance with this embodiment of the present invention. Illustrative specifications for various characteristics of flange 48G shown in FIG. 16 are provided in Table V below.

TABLE V

| CHARACTERISTIC | SPECIFICATION |
|---|---|
| J1 | .090 In. |
| K1 | .400 In. |
| L1 | 1.00 In. |

Figure 17:
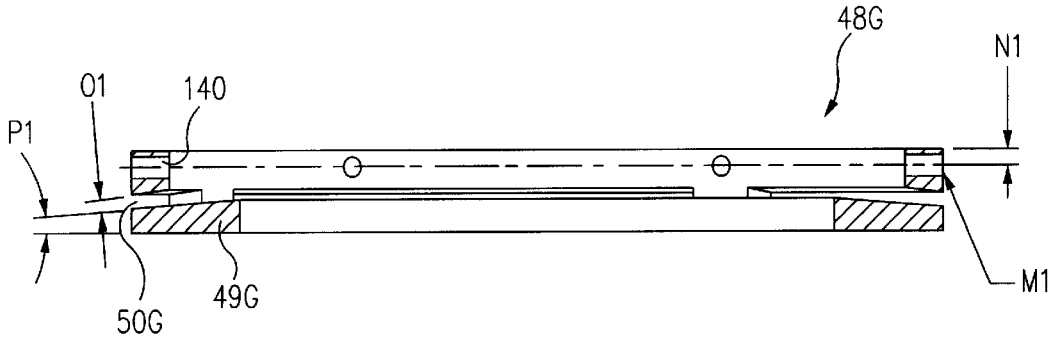
FIG. 17 is a cross-sectional view of the flange taken along the line XVII—XVII of FIG. 15 in accordance with this embodiment of the present invention.

FIG. 17 is a cross-sectional view of flange 48G taken along the line XVII—XVII of FIG. 15 in accordance with this embodiment of the present invention. Illustrative specifications for various characteristics of flange 48G shown in FIG. 17 are provided in Table VI below.

TABLE VI

| CHARACTERISTIC | SPECIFICATION |
|---|---|
| M1 | 6X ¼–20 THRD |
| N1 | .200 In. |
| O1 | .20 In. |
| P1 | 5.9° |

Having thus described the preferred embodiments, persons skilled in the art will recognize that changes may be made in form and detail without departing from the spirit and scope of the invention. For example, although the substrate is described and illustrated as a circular wafer having an electrically conductive seed layer on the plating surface, any substrate having an electrically conductive layer on a substantially planar surface (such as a wafer having a flat) or any electrically conductive substrate having a substantially planar surface can be treated. Further, instead of electroplating a layer on a substrate, the system can be used to electrochemically etch or polish a layer on a substrate. Thus the invention is limited only by the following claims.

We claim:

1. An apparatus for treating a surface of a substrate comprising a flange, said flange having a cylindrical wall and an annulus attached to a first end of said cylindrical wall, said annulus having an inner perimeter which defines a flange central aperture, wherein said flange comprises an electrically conductive material having an electrically insulating coating thereon.

2. The apparatus of claim 1 wherein extending through said cylindrical wall from an inner cylindrical surface to an outer cylindrical surface are one or more apertures.

3. The apparatus of claim 2 wherein said one or more apertures are circular holes.

4. The apparatus of claim 2 wherein said one or more apertures are elongated slots.

5. The apparatus of claim 1 further comprising a cup having a cup central aperture defined by an inner perimeter of said cup.

6. The apparatus of claim 5 wherein a diameter of said flange central aperture is less than a diameter of said cup central aperture.

7. The apparatus of claim 5 wherein said cylindrical wall has one or more threaded bolt holes for attaching said flange to said cup.

8. The apparatus of claim 1 further comprising an anode.

9. The apparatus of claim 8 further comprising a power supply for creating an electrical potential between said substrate and said anode.

10. The apparatus of claim 1 wherein said inner perimeter of said annulus is a surface perpendicular to the plane defined by said flange central aperture.

11. The apparatus of claim 1 wherein said inner perimeter of said annulus is a sloped surface relative to the plane defined by said flange central aperture.

12. An apparatus for treating a surface of a substrate comprising a flange, said flange having a cylindrical wall and an annulus attached to a first end of said cylindrical wall, said annulus having an inner perimeter which defines a flange central aperture, said apparatus further comprising a cup having a cup central aperture defined by an inner perimeter of said cup and a compliant seal adjacent said inner perimeter of said cup.

13. The apparatus of claim 12 further comprising a plurality of contacts adjacent said compliant seal.

14. An apparatus for treating a surface of a substrate comprising a flange, said flange having a cylindrical wall and an annulus attached to a first end of said cylindrical wall, said annulus having an inner perimeter which defines a flange central aperture, said apparatus further comprising a cup having a cup central aperture defined by an inner perimeter of said cup, wherein a second end of said cylindrical wall is attached to said cup.

15. An apparatus for treating a surface of a substrate comprising a flange, said flange having a cylindrical wall and an annulus attached to a first end of said cylindrical wall, said annulus having an inner perimeter which defines a flange central aperture, said apparatus further comprising a spindle for rotating said flange.

16. A combination for treating a surface of a substrate comprising a flange, said flange having a cylindrical wall and an annulus attached to a first end of said cylindrical wall, said annulus having an inner perimeter which defines a flange central aperture, said apparatus further comprising a plating bath containing a plating solution, said plating solution containing copper ions.

17. The combination of claim 16 further comprising a pump for recirculating said plating solution.

18. The combination of claim 16 wherein said plating solution contains ions of an electrically conductive material.

19. Apparatus for electroplating a surface of a substrate comprising:

a plating bath adapted for containing a plating solution;

a cup for holding a peripheral region of a substrate, said cup comprising a compliant seal surrounding a central aperture of said cup;

a flange comprising a vertical wall and an annular member, an upper end of said vertical wall being connected to said cup, a lower end of said vertical wall being connected to said annular member, said vertical wall having a first inner perimeter, said annular member having a second inner perimeter, said second inner perimeter having a diameter that is smaller than a diameter of said first inner perimeter;

an anode adapted for immersion in said plating solution; and a power supply having a positive terminal electrically connected to said anode.

20. The apparatus of claim 19 wherein said flange is formed separately from said cup.

21. The apparatus of claim 19 wherein said flange is formed integrally with said cup.

22. The apparatus of claim 19 wherein said vertical wall comprises a plurality of apertures.

23. The apparatus of claim 19 further comprising a clamshell mechanism, said clamshell mechanism comprising said cup and a cone.

24. The apparatus of claim 23 wherein said clamshell mechanism is mounted on a rotatable spindle.

25. The apparatus of claim 19 wherein said annular member comprises a dielectric material.

26. The apparatus of claim 25 wherein said annular member comprises a conductive material coated with a dielectric material.

27. A combination for performing electroplating comprising:

a clamshell arrangement including a cup and a cone, said cup having a central aperture;

a substrate held between said cup and said cone, said cup contacting said substrate in an area of contact in a peripheral region of said substrate;

a plating bath containing a plating solution, said substrate being immersed in said plating solution;

a flange connected to said cup, said flange comprising a wall and an annulus, said annulus having an inner perimeter portion spaced apart from said substrate and extending inward towards a center of said central aperture beyond said area of contact between said cup and said substrate, a surface of said inner perimeter portion comprising a dielectric material;

an anode immersed in said plating solution; and a power supply having a positive terminal electrically connected to said anode.

28. The combination of claim 27 wherein a plurality of apertures are formed in said wall.

29. The combination of claim 27 wherein said clamshell arrangement is mounted on a rotatable member.

* * * * *